US005366410A

United States Patent [19]

Lombardo

[11] Patent Number: 5,366,410

[45] Date of Patent: Nov. 22, 1994

[54] BUSINESS FORM WITH TRANSFER TAPE AND REPOSITIONAL ADHESIVE

[75] Inventor: Leo Lombardo, Manchester, N.H.

[73] Assignee: Moore Business Forms, Inc., Grand Island, N.Y.

[21] Appl. No.: 26,688

[22] Filed: Mar. 4, 1993

[51] Int. Cl.[5] ..... B41L 1/20

[52] U.S. Cl. ..... 462/6; 462/64; 283/116

[58] Field of Search ..... 283/116, 81, 100, 101; 462/6, 64; 229/300, 64

[56] References Cited

U.S. PATENT DOCUMENTS

| | | | |
|---|---|---|---|
| 2,129,192 | 9/1938 | Berkowitz | 283/116 |
| 2,328,380 | 8/1943 | Feder | 229/300 |
| 2,362,496 | 11/1944 | Mess | 229/300 X |
| 4,479,838 | 10/1984 | Dunsirn et al. | 156/247 |
| 4,526,405 | 7/1985 | Hattemer | 283/81 |
| 4,708,368 | 11/1987 | Instance | 283/81 |
| 4,711,686 | 12/1987 | Instance | 156/227 |
| 4,767,654 | 8/1988 | Riggsbee | 428/40 |
| 4,868,027 | 9/1989 | Hunkeler et al. | 428/42 |
| 4,991,878 | 2/1991 | Cowan et al. | 283/81 |
| 5,031,938 | 7/1991 | Instance | 283/81 |
| 5,071,167 | 12/1991 | O'Brien | 283/79 |
| 5,127,676 | 7/1992 | Bockairo | 283/81 |
| 5,288,015 | 2/1994 | Sauerwine | 229/300 X |

*Primary Examiner*—Willmon Fridie
*Attorney, Agent, or Firm*—Nixon & Vanderhye

[57] ABSTRACT

A business form is provided that can be readily attached to, and then detached from (without adhesive residue remaining on it) an appliance or packaging for an appliance. The business form can have warranty and/or service contract information printed on it. The form includes first, second and third plies, the third ply sandwiched between the first and second plies, with adhesive for attaching the plies together along their peripheral edges. A reply envelope is nested within and between the plies, and a pattern of readily removable adhesive is disposed on the outer face of the second ply. The adhesive is preferably provided by transfer tape, which includes a substrate, with permanent adhesive on the opposite face from the readily removable adhesive, and with the permanent adhesive covered by release paper. When the form is removed from the packaging or appliance, it is detached at lines of weakness near the adhesive connecting the plies together, and then the service contract within it is filled out, inserted into the reply envelope, and mailed to the reply addressee.

20 Claims, 3 Drawing Sheets

FIG. 3
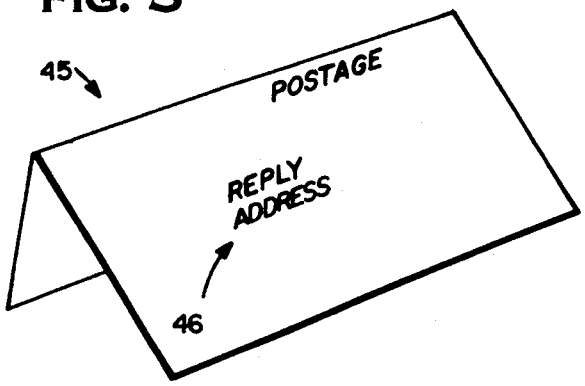
FIG. 4
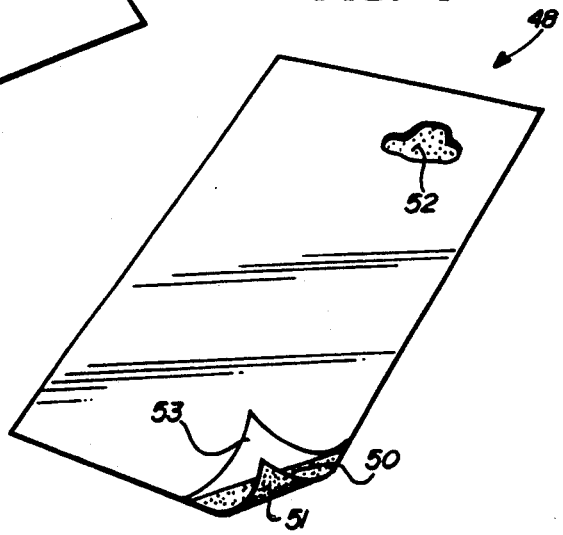
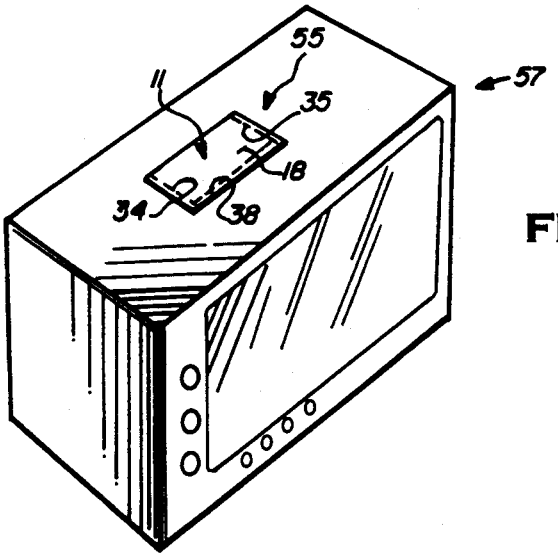
FIG. 5
FIG. 6
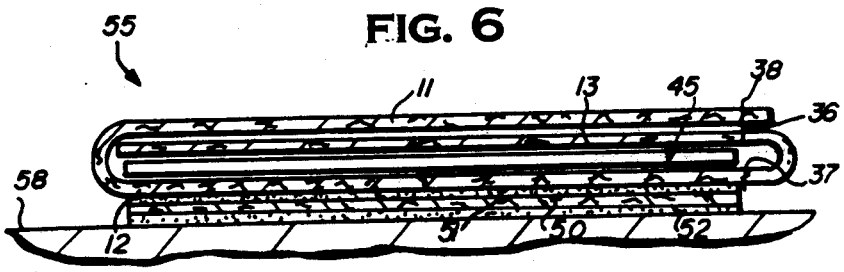

BUSINESS FORM WITH TRANSFER TAPE AND REPOSITIONAL ADHESIVE

BACKGROUND AND SUMMARY OF THE INVENTION

There are many situations in which business forms are desirably provided with appliances when they are sold at retail outlets or the like. Conventionally, when appliances are sold, it is desirable to provide service contract, warranty, or like information and returnable forms with the appliance, including a reply envelope with reply address indicia thereon, so that a customer may fill out the information requested and easily return it to the reply addressee (typically the manufacturer of the appliance, or a service center).

According to the present invention a business form is provided for use with retail sales outlets for appliances that allow the purchaser to have ready access to, quickly fill out, and return service contract or warranty applications, information, or the like. The business form according to the present invention is designed so as to be as simple as possible, and so that no adhesive residue is left on parts of the form, which would be a significant disincentive to the purchaser handling the form to filling it out and returning it. The invention also accomplishes its desired results with a minimum of components that are difficult to recycle. Typically, shipping labels or invoices which accompany cartons are enclosed in protective plastic envelopes, which create additional problems of removal when the carton needs to be recycled. The business form according to the present invention eliminates the need for extra plastic envelopes, or the like, has great ease of removability, and is particularly useful as a point of sale item.

According to one aspect of the present invention a business form is provided having the following elements: A first ply having inner and outer faces and peripheral edges. A second ply having inner and outer faces and peripheral edges. Attachment means for operatively attaching the plies together along peripheral edges thereof. A reply envelope, with reply address indicia thereon, nested within and between the first and second plies. And a pattern of readily removable (e.g., repositional) adhesive disposed on the outer face of the second ply, and covering less than the entire outer face of the second ply, including not covering at least a portion of at least one of the peripheral edges.

The business form preferably comprises a third ply having first and second faces, and nested between the first and second plies. First indicia is printed on at least one of the faces of the third ply, and second indicia is printed on at least the inner face of at least one of the first and second plies. The first and second indicia typically comprises indicia blank spaces relating to a service contract, warranty information, or the like, for an appliance, including blank spaces asking for information about a purchaser/user's name and address.

The business form also typically includes a substrate having first and second faces, the substrate first face attached to the readily removable adhesive opposite the second ply outer face, and permanent adhesive attached to the substrate second face. The permanent adhesive is preferably covered with release paper, the readily removable adhesive, substrate, permanent adhesive, and release paper comprising a piece of transfer tape. The attachment means for operatively connecting the plies together preferably comprises adhesive patterns along the peripheral edges of at least some of the plies, and lines of weakness are formed in the plies adjacent the edges, interiorly of the adhesive patterns.

According to another aspect of the present invention, a business form is provided comprising the following elements: A first ply having inner and outer faces and peripheral edges. A second ply having inner and outer faces and peripheral edges. Attachment means for attaching the plies together along peripheral edges thereof. And a piece of transfer tape comprising: a substrate having first and second faces; a pattern of readily removable adhesive disposed on the first face of the substrate and engaging the outer face of the second ply, and covering less than the entire outer face of the second ply, including not covering at least a portion of at least one of the peripheral edges; permanent adhesive disposed on the second face of the substrate; and a piece of release paper covering the permanent adhesive.

According to yet another aspect of the present invention a method of packaging warranty and/or service contract information for an appliance is provided in the practice of the method one utilizes a business form having a reply envelope with reply addressee indicia thereon nested within first and second plies that are attached together and have inner and outer faces, with at least one inner face of at least one ply printed with warranty and/or service contract information, and a piece of transfer tape connected to an outer face of one of the plies, including readily removable adhesive engaging the outer face of one of the plies, and permanent adhesive facing outwardly from the first and second plies and covered by release paper. The method comprises the steps of: (a) Removing the release paper from the permanent adhesive. (b) Moving the permanent adhesive into contact with packaging for an appliance, or a surface of the appliance, so that the business form is held in contact therewith. (c) Removing the business form from contact with the packaging or appliance by pulling on one of the plies, the readily removable adhesive allowing ready release of the plies from the packaging or appliance. (d) Detaching the plies from each other. (e) Filling out the warranty and/or service contract information. And (f) placing the completed warranty and/or service contract information in the reply envelope, and sending the reply envelope to the reply addressee.

It is a primary object of the present invention to provide a simple, easy to remove, and effective business form for use as a point of sale item associated with appliances or the like. This and other objects of the invention will become clear from an inspection of the detailed description of the invention and from the appended claims.

BRIEF DESCRIPTION OF THE DRAWINGS

FIG. 3 is a top perspective view of an exemplary return envelope used with the business form of the invention;

FIG. 4 is a top perspective view of an exemplary piece of transfer tape providing part of an exemplary business form according to the invention;

FIG. 5 is a top perspective view of an appliance with an exemplary business form according to the invention mounted thereon; and FIG. 6 is a cross-sectional view of an exemplary business form according to the invention shown attached to a carton for an appliance or the like.

DETAILED DESCRIPTION OF THE DRAWINGS

Figure 1:
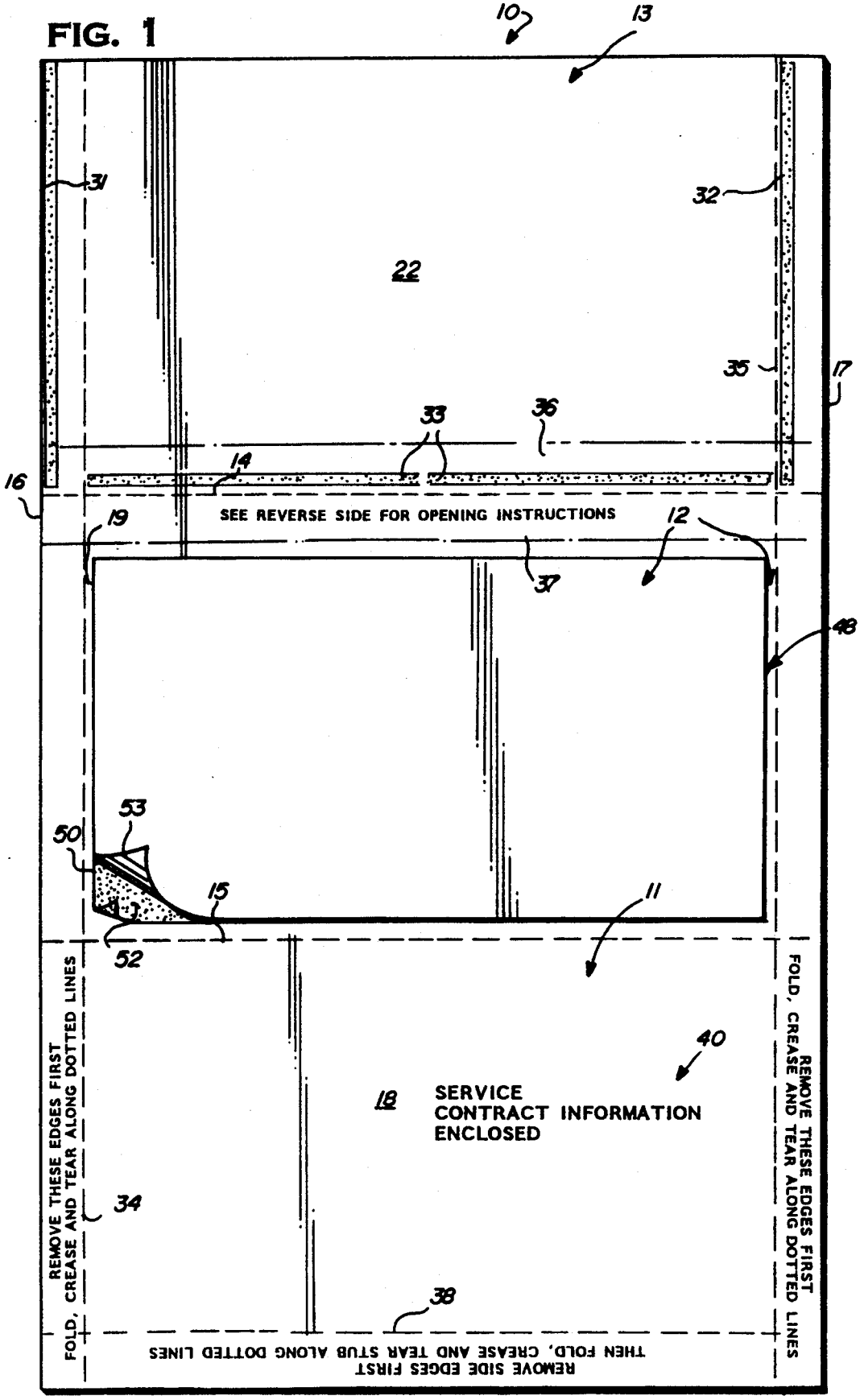
FIG. 1 is a top plan view of one face of an exemplary business form intermediate for forming a business form according to the present invention.
Figure 2:
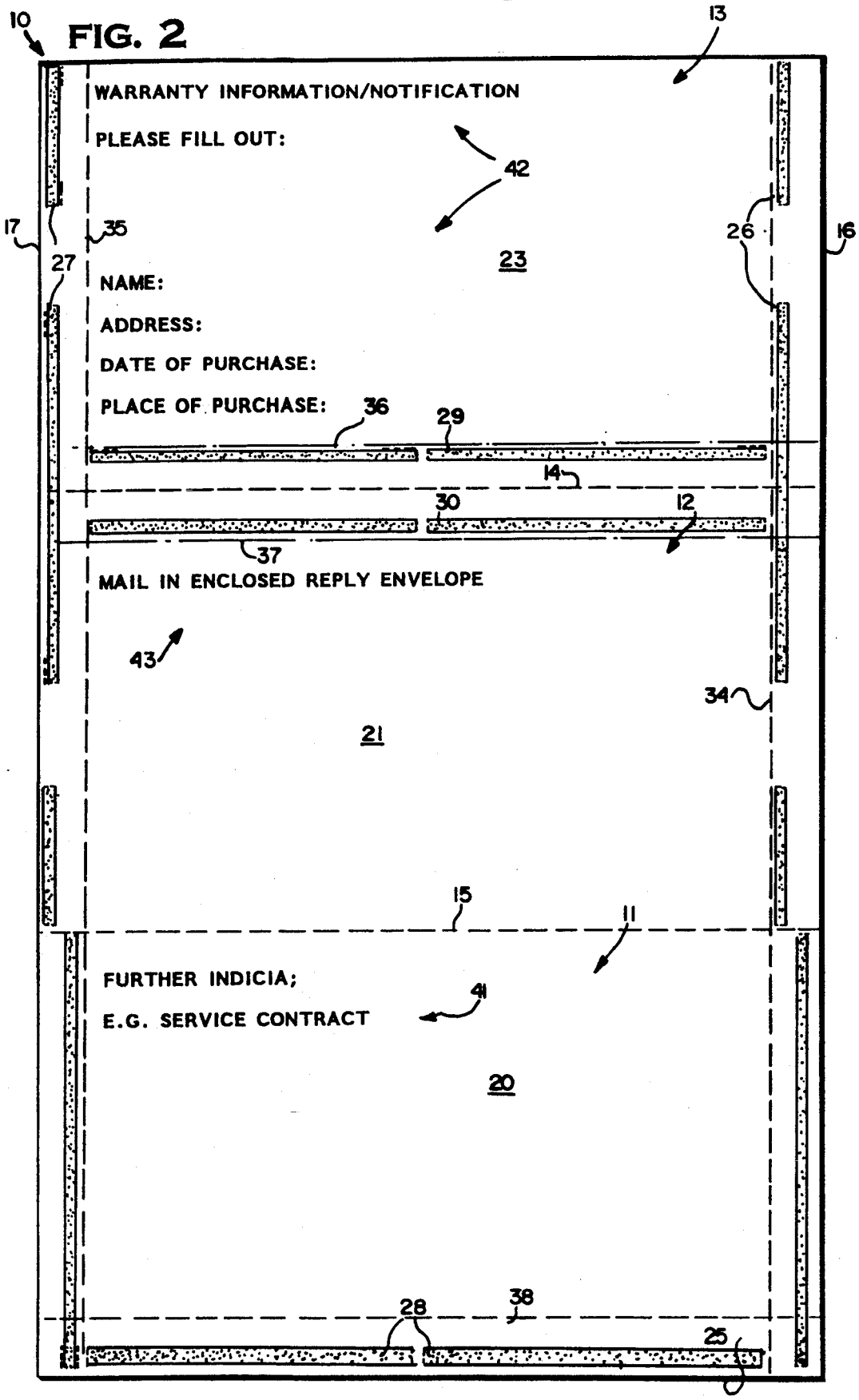
FIG. 2 is a top plan view of the opposite face of the business form intermediate of FIG. 1.

A business form intermediate for use in constructing a business form according to the invention, is shown generally by reference numeral 10 in FIGS. 1 and 2. The intermediate 10 illustrated in FIGS. 1 and 2 comprises a single sheet of paper which, in the final form, has at least first and second plies 11, 12, and preferably also a third ply 13. The plies 11-13 are formed by fold line 15 extending between the side edges 16, 17 of the intermediate paper sheet 10. For the first and second plies 11, 12 shown in FIG. 1, the faces illustrated therein are outer faces when the business form is formed. The outer face for the first ply 11 is indicated by reference numeral 18, while the outer face for the second ply 12 is indicated by reference numeral 19.

FIG. 2 shows the opposite face of the single sheet of paper forming the intermediate 10. For the first and second plies 11, 12 this face is the inner face when the business form is constructed, the inner face of first ply 11 being shown by reference numeral 20, and the inner face for the second ply 12 being shown by reference numeral 21. The third ply 13 in the business form will be nested between the first and second plies 11, 12, and has first and second faces shown by reference numerals 22 (FIG. 1) and 23, respectively.

To form the intermediate 10 into a business form, attachment means are provided for operatively attaching the plies 11–13 together. In the embodiment illustrated in the drawings, the attachment means comprises strips of pressure seal adhesive formed along at least the edges 16, 17 of the intermediate 10, and preferably also along the edge 25 forming an edge of the first ply 11. For example, see the strips of adhesive 26, 27 along the edges 16, 17, respectively, and the strips 28 adjacent the edge 25. Further interior adhesive patterns 29, 30 may be provided for holding the plies 12, 13 together too, as well as the adhesive strips 31, 32 adjacent the edges 16, 17 on the second face 22 of the third ply 13, and the adhesive strips 33 thereon which cooperate with the strips 28 on the inner face 20 of the first ply 11. The pressure seal adhesive is rendered active by passing the form through a pressure sealer, such as a SpeediSealer®, sold by Moore Business Forms.

Lines of weakness are also provided for detaching the portions of the plies 11 through 13 having adhesive strips (e.g., 26, 27, etc. ) thereon in order to utilize the business form. Such lines of weakness may take the form, for example, of the perforation lines 34, 35 parallel to the edges 16, 17, respectively, and further perforation lines may also be associated with all the other strips of adhesive, such as the perforation lines 36 through 38 illustrated in FIGS. 1 and 2.

Indicia may be printed on any one of the faces of any one of the plies, although it preferably is not printed on the outer face 19 of the second (middle) ply 12. For example, see the indicia 40 printed on the outer face 18 of the first ply 11, and the service contract and warranty indicia 41, 42, printed on the inner faces 20, 23 of the first and third plies 11, 13, respectively, as well as additional indicia for instructions, or for service contract or warranty information 43 printed on the inner face 21 of the second ply 12.

Also associated with the intermediate 10 in the construction of the business form according to the invention is a reply envelope, shown generally by reference numeral 45 in FIG. 3, having reply addressee information 46 as indicia thereon.

The business form according to the invention also preferably has a piece of transfer tape, shown generally by reference numeral 48 in FIGS. 1 and 4, associated therewith. The transfer tape includes a substrate 50 having readily removable adhesive (such as repositional adhesive, e.g., Cleantac®, sold by Moore Business Forms of Lake Forest, Illinois) 51 on a first face thereof, and permanent adhesive 52 on a second face thereof opposite the first face. The permanent adhesive 52 is preferably covered by a piece of release paper 53. The piece of transfer tape 48 has dimensions less than the dimensions of the second ply 12 outer face 19, including not covering at least one of the edge portions 16, 17 (or 14, 15 when folded into business form configuration) so that the business form may be readily grasped and removed. The readily removable adhesive 51 is in contact with the outer face 19 of the second ply 12, and the paper forming the sheet 10 can be readily pulled away from the repositional adhesive 51 without any significant adhesive residue remaining on the paper (that is on the outer face 19 of second ply 12).

FIGS. 5 and 6 illustrate a business form according to the present invention, shown generally by reference numeral 55, formed from the sheet 10 folded about the fold lines 14, 15 with the third ply 13 between the first and second plies 11, 12, and the reply envelope 45 nested between them. FIG. 5 schematically illustrates a business form 55 attached to a surface of an appliance, such as the top of the TV 57. FIG. 6 shows the same business form 55 only attached to packaging for an appliance instead of the appliance itself, for example attached to the cardboard carton surface 58 (the cardboard carton having the surface 58 containing the appliance, such as television 57). Note that in FIG. 6 that all of the components of the business form 55 are shown with greatly exaggerated thickness for clarity of illustration.

The business form 55 of FIG. 6 has been applied to the surface 58 of the carton by removing the release paper 53 covering the permanent adhesive 52 (the release paper 53 having slightly less affinity for the permanent adhesive 52 than the readily removable adhesive 51 has for the paper of the face 19 of the second ply 12), and the permanent adhesive 52 is pushed into contact with the surface 58, adhesively attaching thereto.

In a typical manner of construction and use of the business form 55 according to the invention, the sheet 10 is first constructed with the adhesive strips 26, 27, etc., applied thereto, and the various indicia 40–43 printed thereon. Then the reply envelope 45 is nested between the plies 11 through 13 of the form 55, which are formed by folding about the fold lines 14, 15. The folded intermediate thus formed is passed through a sealing machine where the adhesive of the adhesive strips 26, 27, etc., are activated (e.g., by pressure or heat). Then the transfer tape 48 is taken from a roll, or the like, and the readily removable adhesive 51 thereof is pressed onto the outer face 19 of the second ply 12. The forms are shipped in that construction to the point of sale location, at which location they are placed on an appliance 57 or surface 58 of a carton (or like packaging for an appliance) by removing the release paper 53 and pressing the permanent adhesive 52 onto the appropriate surface.

Once the appliance is purchased, the user grasps the plies 11, 12, and pulls on them, the transfer tape 48 not covering at least some portions of the face 19 so that both the plies 11, 12 may be grasped with the user's fingers. When a pulling force is applied to the plies 11, 12, the face 19 of second ply 12 cleanly detaches from the readily removable adhesive 51 (which has a greater affinity for the substrate 50 than for the face 19), so that the business form 55 is completely detached from the appliance and packaging, and no significant amount of adhesive residue remains on face 19. Then the form 55 is opened by detachment along the perforation lines 34, 35, 38, etc., the service contract or warranty information 42, etc., is filled out, then it is placed inside the nested reply envelope 45, the reply envelope 45 is sealed and it is sent to the reply addressee indicated by indicia 46.

It will thus be seen that according to the present invention a simple yet effective business form, and method of packaging warranty and/or service contract information for an appliance, have been provided which achieve the goals of simplicity, ease of use, etc., described above. While the invention has herein been shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A business form comprising:

a first ply having inner and outer faces and peripheral edges;

a second ply having inner and outer faces and peripheral edges;

attachment means for operatively attaching said plies together along peripheral edges thereof;

a reply envelope, with reply address indicia thereon, nested within and between said first and second plies; and a pattern of readily removable adhesive disposed on said outer face of said second ply, and covering less than said entire outer face of said second ply, including not covering at least a portion of at least one of said peripheral edges.

2. A business form as recited in claim 1 further comprising a third ply having first and second faces, said third ply nested between said first and second plies.

3. A business form as recited in claim 2 further comprising first indicia printed on at least one of said faces of said third ply.

4. A business form as recited in claim 3 further comprising second indicia printed on at least said inner face of at least one of said first and second plies.

5. A business form as recited in claim 4 wherein at least one of said first and second indicia comprises indicia and blank spaces asking for information about a user's name and address.

6. A business form as recited in claim 4 wherein at least one of said first and second indicia comprises indicia and blank spaces relating to a service contract, or warranty information, for an appliance.

7. A business form as recited in claim 1 further comprising a substrate having first and second faces, said substrate first face attached to said readily removable adhesive opposite said second ply outer face; and permanent adhesive attached to said substrate second face.

8. A business form as recited in claim 7 further comprising release paper covering said permanent adhesive.

9. A business form as recited in claim 8 wherein said readily removable adhesive, substrate, permanent adhesive, and release paper comprise a piece of transfer tape.

10. A business form as recited in claim 1 wherein said attachment means comprises adhesive patterns operatively connecting said first and second plies together along peripheral edges thereof; and further comprising lines of weakness formed in said first and second plies adjacent said edges, interiorly of said adhesive patterns.

11. A business form as recited in claim 7 wherein said attachment means comprises adhesive patterns operatively connecting said first and second plies together along peripheral edges thereof; and further comprising lines of weakness formed in said first and second plies adjacent said edges, interiorly of said adhesive patterns.

12. A business form as recited in claim 2 wherein said attachment means comprises adhesive patterns operatively connecting said first and second plies together along peripheral edges thereof; and further comprising lines of weakness formed in said first and second plies adjacent said edges, interiorly of said adhesive patterns.

13. A business form comprising:

a first ply having inner and outer faces and peripheral edges;

a second ply having inner and outer faces and peripheral edges;

attachment means for attaching said plies together along peripheral edges thereof; and a piece of transfer tape comprising: a substrate having first and second faces; a pattern of readily removable adhesive disposed on said first face of said substrate and engaging said outer face of said second ply, and covering less than said entire outer face of said second ply, including not covering at least a portion of at least one of said peripheral edges; permanent adhesive disposed on said second face of said substrate; and a piece of release paper covering said permanent adhesive.

14. A business form as recited in claim 13 further comprising a third ply having first and second faces, said third ply nested between said first and second plies.

15. A business form as recited in claim 14 further comprising first indicia printed on at least one of said faces of said third ply, and second indicia printed on at least said inner face of at least one of said first and second plies.

16. A business form as recited in claim 15 wherein at least one of said first and second indicia comprises indicia and blank spaces asking for information about a user's name and address.

17. A business form as recited in claim 15 wherein at least one of said first and second indicia comprises indicia and blank spaces relating to a service contract, or warranty information, for an appliance.

18. A business form as recited in claim 14 wherein said attachment means comprises adhesive patterns operatively connecting said first and second plies together along peripheral edges thereof; and further comprising lines of weakness formed in said first and second plies adjacent said edges, interiorly of said adhesive patterns.

19. A business form as recited in claim 13 wherein said attachment means comprises adhesive patterns operatively connecting said first and second plies together along peripheral edges thereof; and further comprising lines of weakness formed in said first and second plies adjacent said edges, interiorly of said adhesive patterns.

20. A method of packaging warranty and/or service contract information for an appliance, utilizing a business form having a reply envelope with reply addressee indicia thereon nested within first and second plies that are attached together and have inner and outer faces, with at least one inner face of at least one ply printed with warranty and/or service contract information, and a piece of transfer tape connected to an outer face of one of the plies, including readily removable adhesive engaging the outer face of one of the plies, and permanent adhesive facing outwardly from the first and second plies and covered by release paper, the method comprising the steps of:

(a) removing the release paper from the permanent adhesive;

(b) moving the permanent adhesive into contact with packaging for an appliance, or a surface of the appliance so that the business form is held in contact therewith;

(c) removing the business form from contact with the packaging or appliance by pulling on one of the plies, the readily removable adhesive allowing ready release of the plies from the packaging or appliance;

(d) detaching the plies from each other;

(e) filling out the warranty and/or service contract information; and (f) placing the completed warranty and/or service contract information in the reply envelope, and sending the reply envelope to the reply addressee.

* * * * *